US005269408A

United States Patent [19]

Otis et al.

[11] Patent Number: 5,269,408

[45] Date of Patent: Dec. 14, 1993

[54] HANG-UP DISPLAY BOX FOR SHOES

[75] Inventors: Jon D. Otis, Long Branch, N.J.; Terry J. Hooper, York, Pa.

[73] Assignee: E. S. Originals, Inc., New York, N.Y.

[21] Appl. No.: 35,048

[22] Filed: Mar. 22, 1993

[51] Int. Cl.[5] ..... B65D 5/18

[52] U.S. Cl. ..... 206/288; 206/278; 206/806; 211/38; 211/88; 211/113

[58] Field of Search ..... 206/44 R, 45.14, 278, 206/279, 288, 292, 461, 806; 211/34, 35, 38, 71, 87, 88, 113

[56] References Cited

U.S. PATENT DOCUMENTS

| | | | |
|---|---|---|---|
| 1,909,942 | 5/1933 | Fingerman | 206/278 |
| 1,974,156 | 9/1934 | Hockmeyer | 206/278 |
| 2,990,960 | 7/1961 | Rafferty | 211/35 |
| 4,424,906 | 1/1984 | Richmond | 206/45.14 |
| 4,795,029 | 1/1989 | Campbell et al. | 211/38 |
| 4,819,792 | 4/1989 | Christian | 206/45.25 |
| 4,967,913 | 11/1990 | Bayer | 211/38 |
| 4,993,583 | 2/1991 | Chasen | 206/806 |
| 5,193,671 | 3/1993 | Patterson | 206/278 |

FOREIGN PATENT DOCUMENTS

| | | | |
|---|---|---|---|
| 1195156 | 11/1959 | France | 206/806 |

*Primary Examiner*—Jimmy G. Foster
*Attorney, Agent, or Firm*—Kirschstein, et al.

[57] ABSTRACT

A combination transport-display box for shoes openly displays the shoes in an upright display condition in which the shoes directly face a purchaser.

7 Claims, 1 Drawing Sheet

HANG-UP DISPLAY BOX FOR SHOES

BACKGROUND OF THE INVENTION

1. Field of the Invention

This invention generally relates to shoe boxes and, more particularly, to hang-up display boxes for shoes.

2. Description of Related Art

Shoes of various styles are displayed on open racks or shelves in retail stores. A consumer selects a certain style, and either obtains the correct size from nearby inventory in discount stores, or, in more upscale stores, asks a clerk to retrieve the correct size from inventory accessible only to store personnel. In either event, the inventoried shoes are packed in closed shoe boxes having removable lids. The shoe boxes protect the shoes during transport to the store, as well as to the consumer's home. In some cases, the lids are removed and the shoe boxes are placed on the open racks or shelves, thereby enabling the consumer to have ready access to the shoes within the boxes. However, the shoes are not readily visible to the consumer due, primarily, to the presence of protective tissue paper within the boxes, which paper tends to obscure the shoes.

SUMMARY OF THE INVENTION

1. Objects of the Invention

It is an object of this invention to suspend a shoe box so that a pair of shoes therein is vertically positioned in an upright display condition facing a consumer.

It is another object of this invention to enable the box used to transport the shoes to serve also to display the shoes.

2. Features of the Invention

In keeping with these objects, and others which will become apparent hereinafter, one feature of this invention resides, briefly stated, in a hang-up display box for shoes. The box comprises a generally planar rear panel having a predetermined height dimension, and a generally planar base panel attached to, and inclined at an acute angle of inclination relative to, the rear panel. The angle of inclination lies in a range from about 50°-85°, preferably 70°.

The box further comprises a generally planar front panel attached to, and lying generally normal to, the base panel. The front panel has a height dimension less than said predetermined height dimension. Also, a pair of generally planar end panels are spaced apart from each other along a first direction and extend between the front and rear panels in mutual parallelism along a second direction normal to said first direction.

The front panel, base panel, end panels and rear panel bound a pocket for receiving a pair of shoes. The pocket has an open end past which the shoes project. Preferably, the end panels have the same height dimension as the front panel. Also, all the panels are integrally constituted of a heavyweight paper material.

The box further comprises means on the rear panel for suspending the pair of shoes in an upright display condition in which the front panel lies in a vertical plane facing a viewer, and in which the base panel lies in a horizontal plane parallel to the floor. Preferably, this means is constituted by a hang-up hole extending through the rear panel.

Thus, in accordance with this invention, the box serves as both a transport package and a display package. The acute angle of inclination between the rear and base panels is especially designed to be certain that the shoes are displayed in an upright condition. It will be appreciated that if the rear and base panels were perpendicular to each other, the shoes would not face fully front, but partly downwardly toward the floor, because the weight of the shoes at one side of the rear panel swings the rear panel about its support at the hang-up hole.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
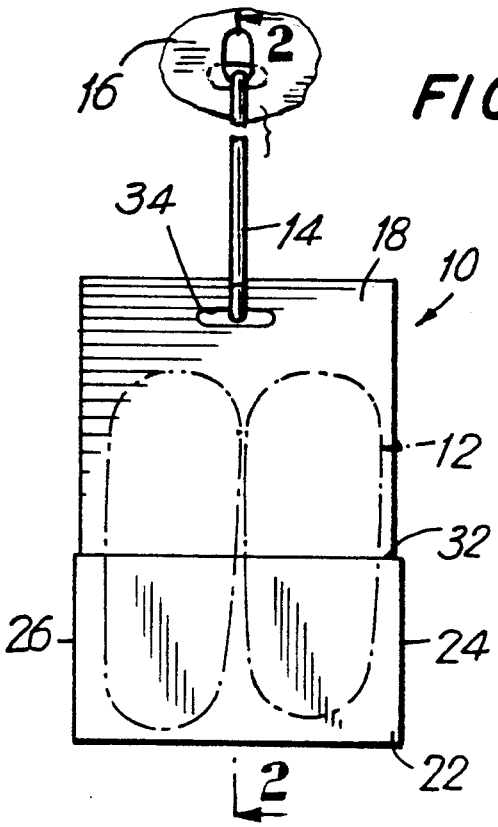
FIG. 1 is a front, elevational view of a hang-up display box in accordance with this invention.

Referring to the drawings, reference numeral 10 generally identifies a display box for a pair of shoes 12. As described below, the box 10 is suspended from an overhead hook 14 which, in turn, is mounted on a support, such as a pegboard 16.

Box 10 includes a generally planar, rectangular, rear panel 18 having a predetermined vertical height dimension. A generally planar, rectangular, base panel 20 is integrally attached to, and inclined at an acute angle of inclination relative to, the rear panel 18. This angle lies in a range from about 50° to about 85°, preferably 70°.

Box 10 further includes a generally planar, rectangular, front panel 22 attached, and lying generally normal, to the base panel 20. The front panel 22 has a height dimension less than, and preferably more than one-half, the predetermined height dimension of the rear panel. A pair of generally planar end panels 24, 26 is spaced apart from each other along a first width direction. End panels 24, 26 extend between the front 22 and rear 18 panels in mutual parallelism along a second depth dimension normal to the width direction. The end panels preferably have the same height dimension as the front panel.

All of the panels are preferably integrally constituted of a single, foldable sheet of heavyweight paper material, such as cardboard. All the panels have a single thickness, except for the rear panel 18 which has a double thickness. Flaps such as base flaps 28 are glued to the end panels to maintain the box in its illustrated erect state.

All the panels bound a pocket 30 for receiving the pair of shoes 12. Any shoe types may be mounted in the pocket. In the preferred embodiment, the shoes are baby shoes, and are inserted heel-first into the pocket, thereby allowing at least the toe portions of the shoes to project outwardly through and past an open end 32 of the pocket. The backs of the heels rest against the base panel 20. The front of the outsoles rest against the rear panel 18.

Figure 2:
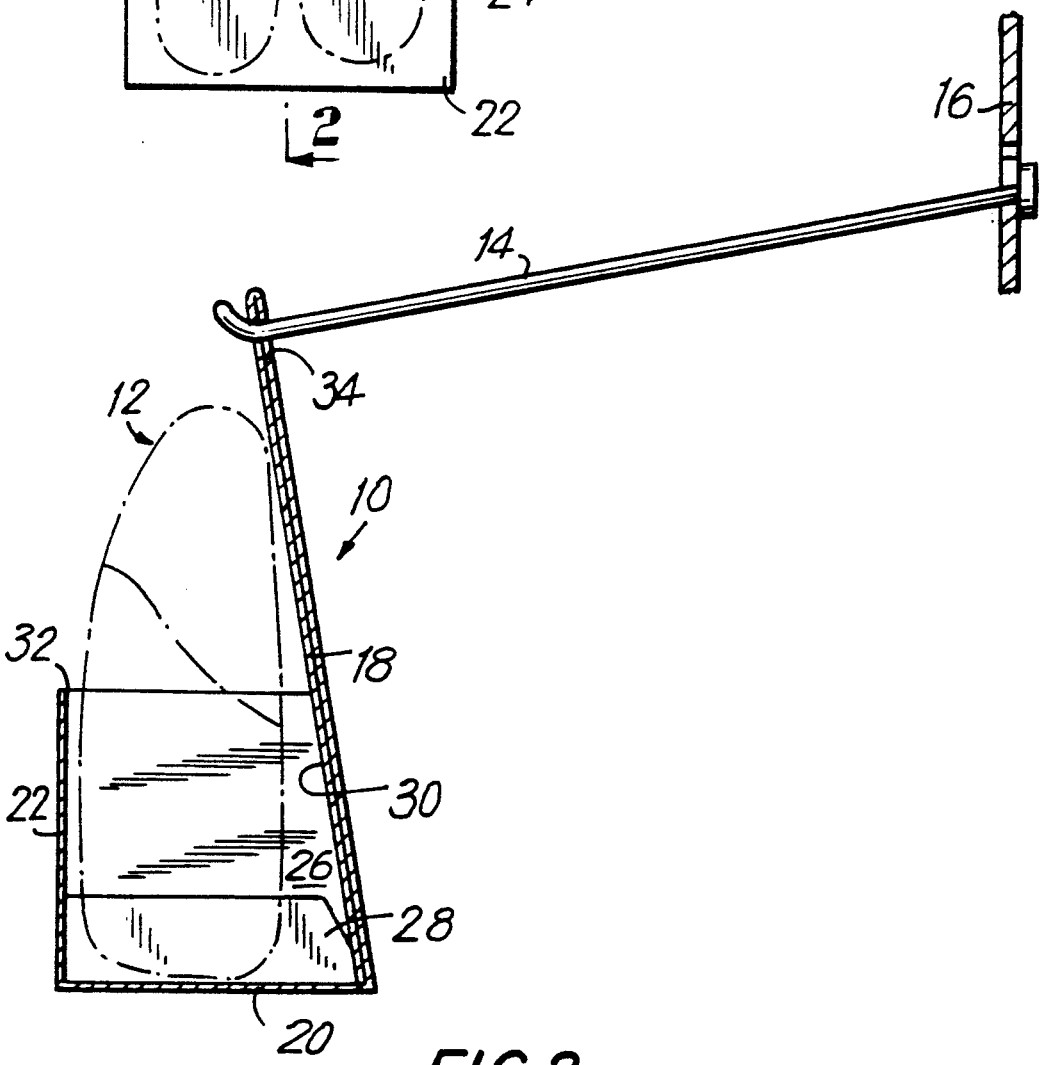
FIG. 2 is an enlarged, sectional view taken on line 2—2 of FIG. 1.

A hang-up hole 34 at the upper end of the rear panel extends therethrough and receives the hook 14, thereby serving as a means to suspend the shoes in an upright display condition, best illustrated in FIG. 2, wherein the front panel 22 lies in a vertical plane directly facing a viewer, and wherein the base panel 20 lies in a horizontal plane parallel to the floor, and wherein the rear panel 18 is inclined at said acute angle of inclination relative to the floor. As noted above, the weight of the shoes 12 positioned at one side of the rear panel 18 tends to swing the rear panel about its overhead support at hook 14 within the hole 34.

The shoes are conveniently shipped and displayed in the box 10. If desired, a transparent plastic overwrap can be positioned about the box and the shoes to resist dust contamination.

It will be understood that each of the elements described above, or two or more together, also may find a useful application in other types of constructions differing from the types described above.

While the invention has been illustrated and described as embodied in a hang-up display box for shoes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A hang-up display box for shoes, comprising:

(a) a generally planar rear panel having a predetermined height dimension;

(b) a generally planar base panel attached to, and inclined at an acute angle of inclination relative to, the rear panel;

(c) a generally planar front panel attached to, and lying generally normal to, the base panel, said front panel having a height dimension less than said predetermined height dimension;

(d) a pair of generally planar end panels spaced apart from each other along a first direction, and extending between the front and rear panels in mutual parallelism along a second direction normal to said first direction;

(e) said front panel, base panel, end panels and rear panel bounding a pocket for receiving a pair of shoes, said pocket having an open end past which the shoes project; and (f) means on the rear panel for suspending the pair of shoes in an upright display condition in which the front panel lies in a vertical plane facing a viewer.

2. The display box according to claim 1, wherein the front, base and rear panels have rectangular shapes.

3. The display box according to claim 1, wherein the angle of inclination lies in a range from about 50° to about 85°.

4. The display box according to claim 1, wherein the base panel lies in a horizontal plane parallel to the floor in the upright display condition.

5. The display box according to claim 1, wherein the end panels have the same height dimension as the front panel.

6. The display box according to claim 1, wherein the suspending means includes a hang-up hole extending through the rear panel.

7. The display box according to claim 1, wherein all the walls are integrally constituted of a heavyweight paper material.

* * * * *